United States Patent [19]

Vecchia

[11] Patent Number: 4,835,880

[45] Date of Patent: Jun. 6, 1989

[54] AIR PERCUSSION AND AIR SUCTION DRYER FOR MACHINES FOR CONTINUOUS TEXTILE TREATMENT

[75] Inventor: Gino D. Vecchia, Santorso, Italy

[73] Assignee: Sperotto Rimar S.p.A., Vicenza, Italy

[21] Appl. No.: 112,677

[22] Filed: Oct. 23, 1987

[30] Foreign Application Priority Data

Nov. 28, 1986 [IT] Italy ..... 22511 A/86

[51] Int. Cl.[4] ..... F26B 13/30

[52] U.S. Cl. ..... 34/115; 34/122; 34/86

[58] Field of Search ..... 34/115, 122, 86

[56] References Cited

U.S. PATENT DOCUMENTS

| | | | |
|---|---|---|---|
| 3,098,371 | 7/1963 | Fleissner | 34/115 |
| 3,541,697 | 11/1970 | Villalobos | 34/122 |
| 4,135,310 | 1/1979 | Fuhring et al. | 34/115 X |
| 4,137,646 | 2/1979 | Fuhring | 34/115 X |
| 4,145,819 | 3/1979 | Fleissner | 34/115 X |
| 4,364,185 | 12/1982 | Dussourd et al. | 34/122 |
| 4,462,868 | 7/1984 | Oubridge et al. | 34/115 X |
| 4,677,761 | 7/1987 | Rattner | 34/115 X |

*Primary Examiner*—Henry A. Bennet

*Attorney, Agent, or Firm*—Roberts, Spiecens & Cohen

[57] ABSTRACT

A rotary-drum dryer for machines for continuous treatment of fabrics, operating by air percussion and air suction, either selectively or in combination, equipped with a set of control elements, able to realize different operating positions, with different distribution of both blown and intake air.

11 Claims, 4 Drawing Sheets

AIR PERCUSSION AND AIR SUCTION DRYER FOR MACHINES FOR CONTINUOUS TEXTILE TREATMENT

FIELD OF INVENTION

The present invention relates to an air percussion and air suction dryer for machines for the continuous treatment of textile materials.

BACKGROUND

The use on machines for the continuous treatment of textile materials, of both air-suction dryers and air-percussion dryers is known.

Exactly this selectivity of the type of drying treatment does not make it possible to operate with the same efficiency on all fabric types, largely limiting the oeprating flexibility, and the productivity of the machine.

SUMMARY OF THE INVENTION

A purpose of the present invention is to provide a high-efficiency dryer, extremely versatile in operation, so to be able to operate both in air percussion and in air suction mode, or even according to a combination of said two operating modes.

Furthermore, it must be possible to obtain this flexibility in an easy and simple way, without requiring any major actions to be carried out on the dryer.

These and further objects according to the invention are achieved by providing an air-percussion and air-suction dryer for machines for continuous textile treatment of the type comprising means for the forced delivery of air onto a continuously fed fabric, and means for the forced suction of air through said fabric, characterized in that said means for the forced air delivery and for the forced air suction are positioned in correspondence with a revolving, perforated, cylindrical drum, around which said fabric is fed, and also in correspondence with said drum, is a means for the control of the distribution of air respectively delivered and sucked by said air delivery and air suction means to and from the interior of the dryer.

BRIEF DESCRIPTION OF THE DRAWINGS

The structural and functional characteristics, and the advantages of a dryer according to the present invention will be better understood from the following exemplifying, non limitative disclosure, referred to the hereto attached schematic drawings, wherein.

DETAILED DESCRIPTION OF PREFERRED EMBODIMENTS

Figure 1:
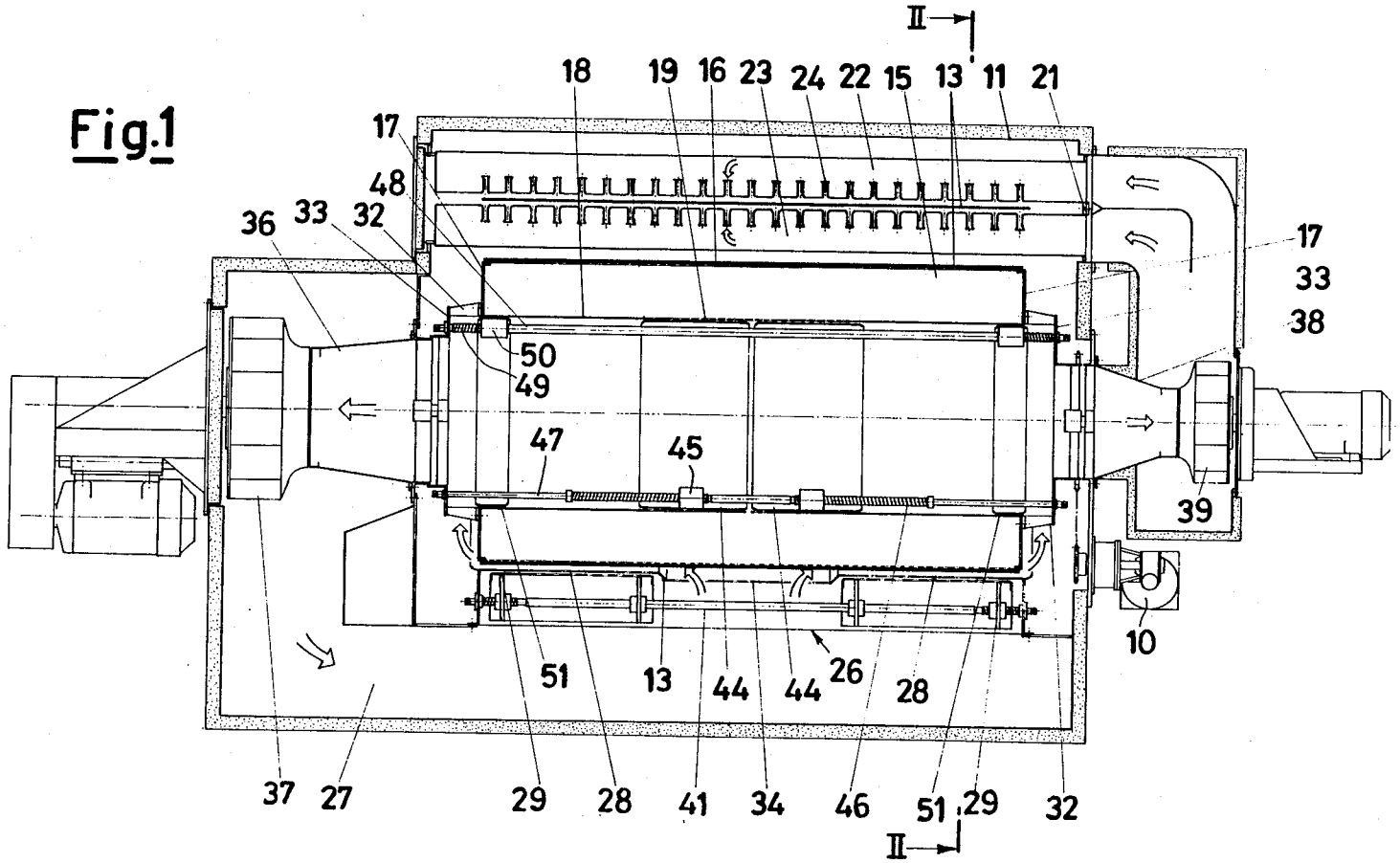
FIG. 1 is a longitudinal sectional view of the dryer according to the invention.
Figure 2:
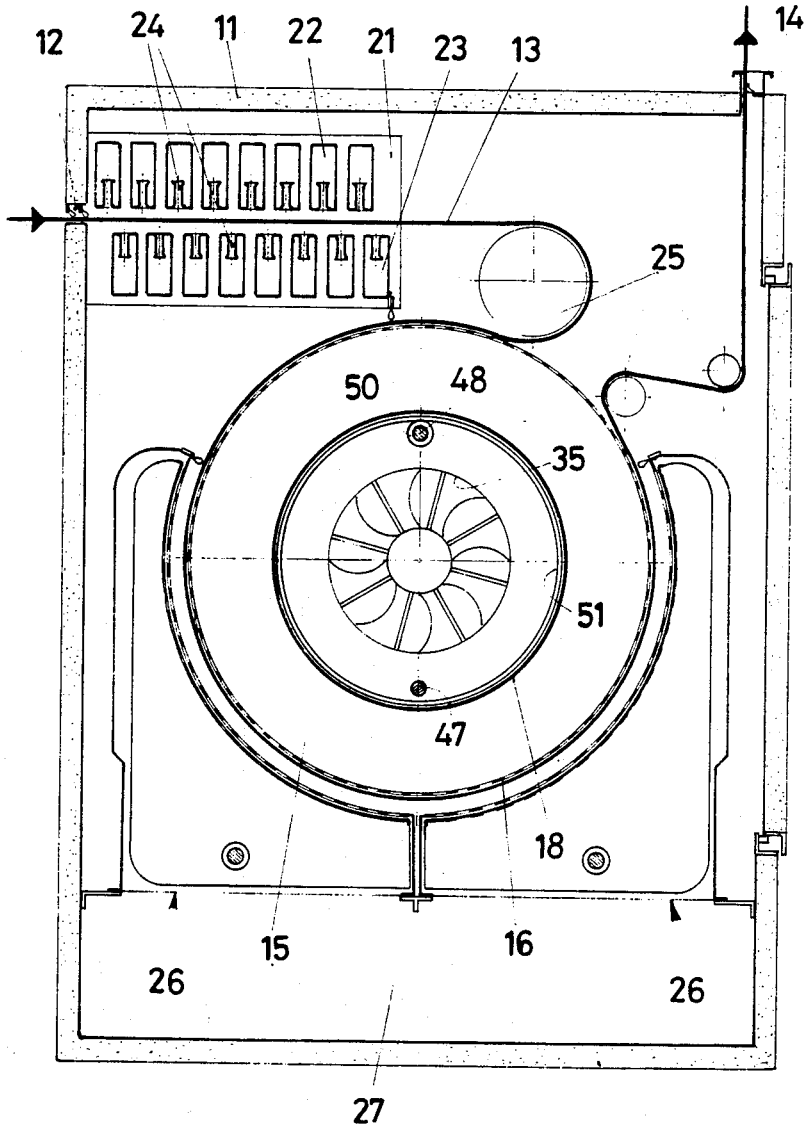
FIG. 2 is an enlarged sectional view of the dryer taken along line II—II in FIG. 1.

Referring to the Figures, an air-percussion and air-suction dryer according to the invention essentially comprises a closed external self-supporting framework 11, provided with an air-tight inlet port 12, through which a continuous fabric 13 to be dried is fed, and with an air-tight outlet port 14, through which the dried fabric 13 leaves the dryer.

Inside the framework 11 a rotatably supported hollow, cylindrical drum 15 is provided, which is driven in rotation by a motor-driven transmission 10, said drum being constituted by an external uniformly perforated, cylindrical element 16, and by an internal cylindrical element 18, coaxial with said external perforated cylindrical element 16, said cylindrical elements 16 and 18 being mutually constrained for common rotation by ring-shaped end heads 17.

Laterally of said ring-shaped end heads 17, further shaped heads 33 are provided, parallel to, and spaced from said first heads, and secured to them by means of linking elements, such as spokes. Such an arrangement defines annular-crown radial openings 32.

The shaped heads 33 are provided with a central opening 35, so to make possible the connection, at one side, through a first conical suction element 36, with a first fan 37 provided inside a first bottom portion of delivery chamber 27, and, at the other side, through a second conical suction elemente 38, with a second fan 39.

The inner cylindrical element 18 is provided with a central ring-like portion 19, which is also uniformly perforated and is respectively connected with the fans 37 and 39 by means of end openings 20, aligned with the openings 35.

Above said cylindrical drum 15, and parallel to its axis, is an air delivery channel 21 to deliver air coming from the second fan 39 towards the fabric 13, composed by a double set of air distribution chests 22 and 23, positioned above and below the fabric 13, crosswise relative to its running direction.

The upper set of air chests 22 and the lower set of air chests 23 are staggered relative to each other with reference to the fabric 13, and at their surfaces facing the fabric 13, they are provided with a plurality of blowing pipes, or air delivery nozzles, 24. The staggered positioning of the pipes 24 enables delivered air to find an easier vent through the fabric 13.

Of course the fabric 13, continuously fed into the dryer, is guided to run between the two sets of air chests 22 and 23, around the cylindrical drum 15 and then towards the outlet port 14 by a set of return rollers 25, suitably positioned and rotatably integral inside the framework 11.

In correspondence with said cylindrical drum 15, a pair of tanks 26, identical, and opposite each other, are provided in the immediate vicinity of said drum 15, to distribute air coming from a first bottom portion of delivery chamber 27.

End portions 28 of the wall of tanks 26 facing cylindrical drum 15, and surrounding it, are provided with a plurality of perforations, and are equipped, in their interior, with cylindrical-section-shaped metal plates 29, having a complementary shape and perforation pattern the plates 29 being, movable, to act, in cooperation with said end portions 28, as a control means to control the distribution of air coming into the interior of tanks 26 from the first bottom portion of delivery chamber 27. A central portion 34 of the drum-facing wall of the tanks 26 is provided with a set of perforations, the central portion 34 being spaced greater distance from the cylindrical drum 15 and allows air to continuously flow therethrough.

The cylindrical-sector-shaped metal plates 29 which constitute the control means inside the tanks 26 are moved between their closing and opening positions by a shaft 41, rotatably supported by the end walls of the tanks 26, with end worm portions 42, which operatively engage complementary nut screws 43 integral with said cylindrical-sector-shaped metal plates 29.

In a similar way, further air distribution control means are provided to control the air distribution inside the secured cylindrical element 18 of the cylindrical drum 15.

A pair of hollow cylindrical elements 44 are positioned in correspondence with the central ring-like portion 19, and are internally provided with integral nut screws 45, operatively engaging worm portions 46 centrally provided on a second shaft 47 rotatably supported at its ends by the further shaped heads 33.

In an equivalent way, the further heads 33 rotatably support a third shaft 48, with end worm portions 49, operatively engaging complementary nut screws 50 with which a second pair of hollow cylindrical elements 51 are integral, which act as shutters for the annular-crown radial openings 32.

Figure 3:
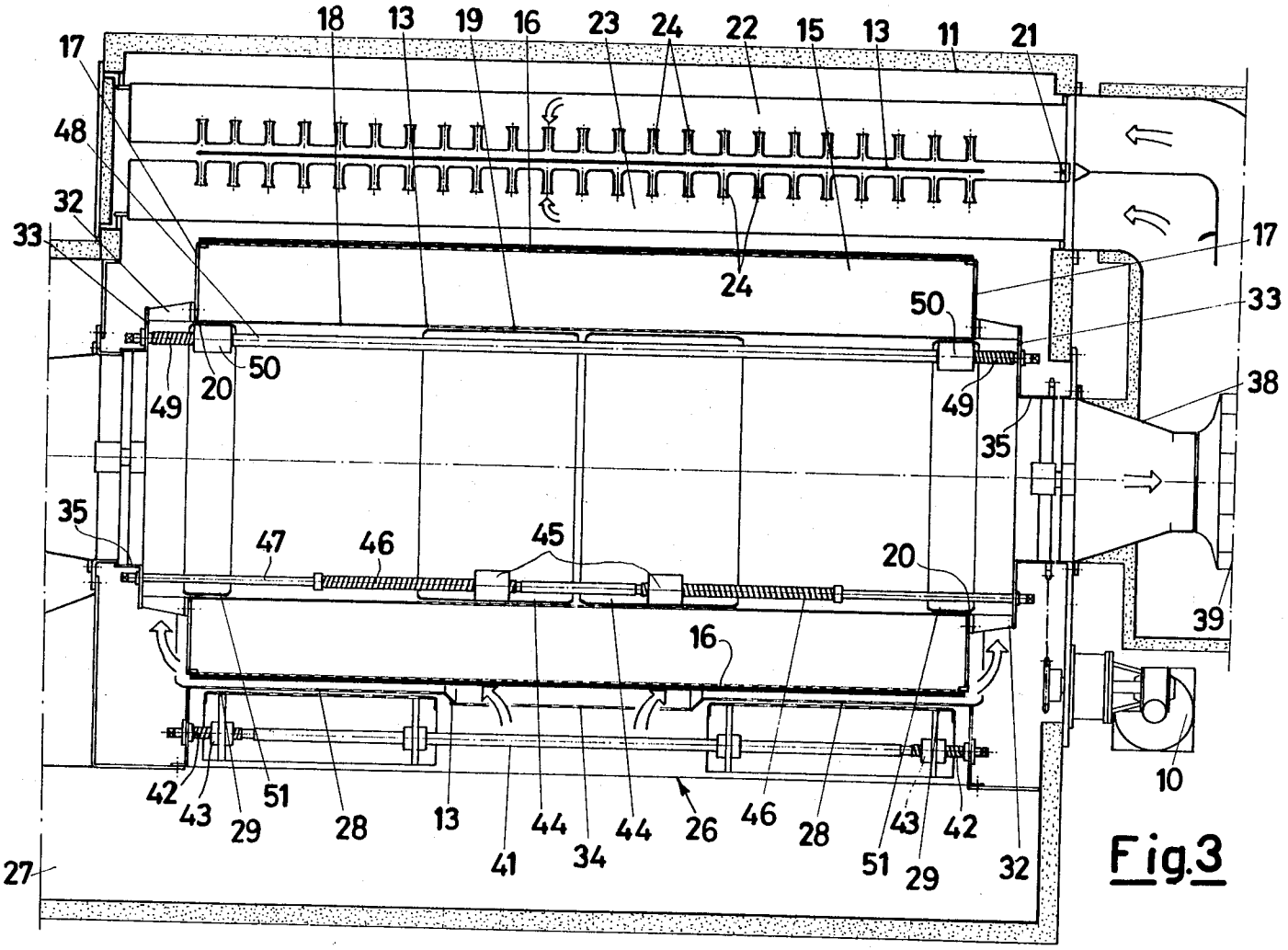
FIG. 3 is an enlarged portion of a longitudinal sectional view equivalent to that in FIG. 1.

In a first operating position, as shown in FIGS. 1 and 3, air is circulated inside the dryer by means of the two fans 37 and 39, each fan intaking, from one of the two related suction cones 36 and 38, air, from the interior of drum 15.

The fan 39 delivers air into the channel 21 and, then, through the two sets of distribution chests 22 and 23 and the related blowing pipes 24, onto the fabric 13, while the fan 37 delivers air through the first portion of delivery chamber 27 to the distribution tanks 26. From these, both through the perforated plate portion 34, and the end portions 28, which in this case are open, of the drum-facing wall of the tanks 26, air is delivered towards the drum 15, around which the fabric 13 is wound.

Air blown from tanks 26 towards the drum 15, upon finding the central perforated ring-like portion 19 of the inner cylindrical element 18 closed by the pair of cylindrical elements 44, and upon finding the annular-crown radial openings 32 on the two heads of the drum 15, open is sucked through the annular-crown radial openings 32, being thus forced to contact the surface of the external cylindrical element 16 of the drum 15, and, consequently, the fabric 13 wound around drum 15. In so doing, air flow is promoted by the narrow free gap constituting the air passage between the facing walls of the two tanks 26 and the external cylindrical element 16 of drum 15.

Such an effect of air streaming in the tangential direction relative to the drum 15 can be furthermore enhanced by closing the air passage perforations provided on the two end portions 28 of the drum-facing wall of the tanks 26 by means of the two cylindrical-sector-shaped metal plates 29, so to oblige air to exclusively flow through the central portion 34 (FIG. 3).

In the same way, air blown from channel 21 and from pipes 24 is sucked through said annular-crown radial openings 32, and, from there, is recycled through the suction cones 36 and 38, by the fans 37 and 39.

The above-disclosed situation corresponds to the operating mode by air percussion against the drum 15 and the fabric 13 wound around it. The air-percussion system is particularly suitable and efficacious for drying high-thickness or very beaten, or air-tight fabrics, for which the traditional drying systems by sucked air are not effective.

Another basic application of the air-percussion system with an orientated air flow is the drying of knitted fabrics with rolled-up selvedges. In that case, the fabric 13 is made to run round the drum 15 in such a way that the selvedges tend to round up upwards inside the space left free between the drum 15 and the tanks 26 partially surrounding drum 15.

The air steam blown from the tanks 26 and sucked through the annular-crown radial openings 32 of the drum heads 15 flows therefore inside the narrow free gap existing between said tanks 26 and said drum 15, tangentially of 15 and consequently opening and spreading the selvedges of the fabric 13 wound around said drum 15 and hence making it possible for them to be completely dried. On the contrary, the traditional drying systems with sucked and not-oriented air do not effect selvedge unrolling and opening, thus leaving these fabric portions in a damp state.

Figure 4:
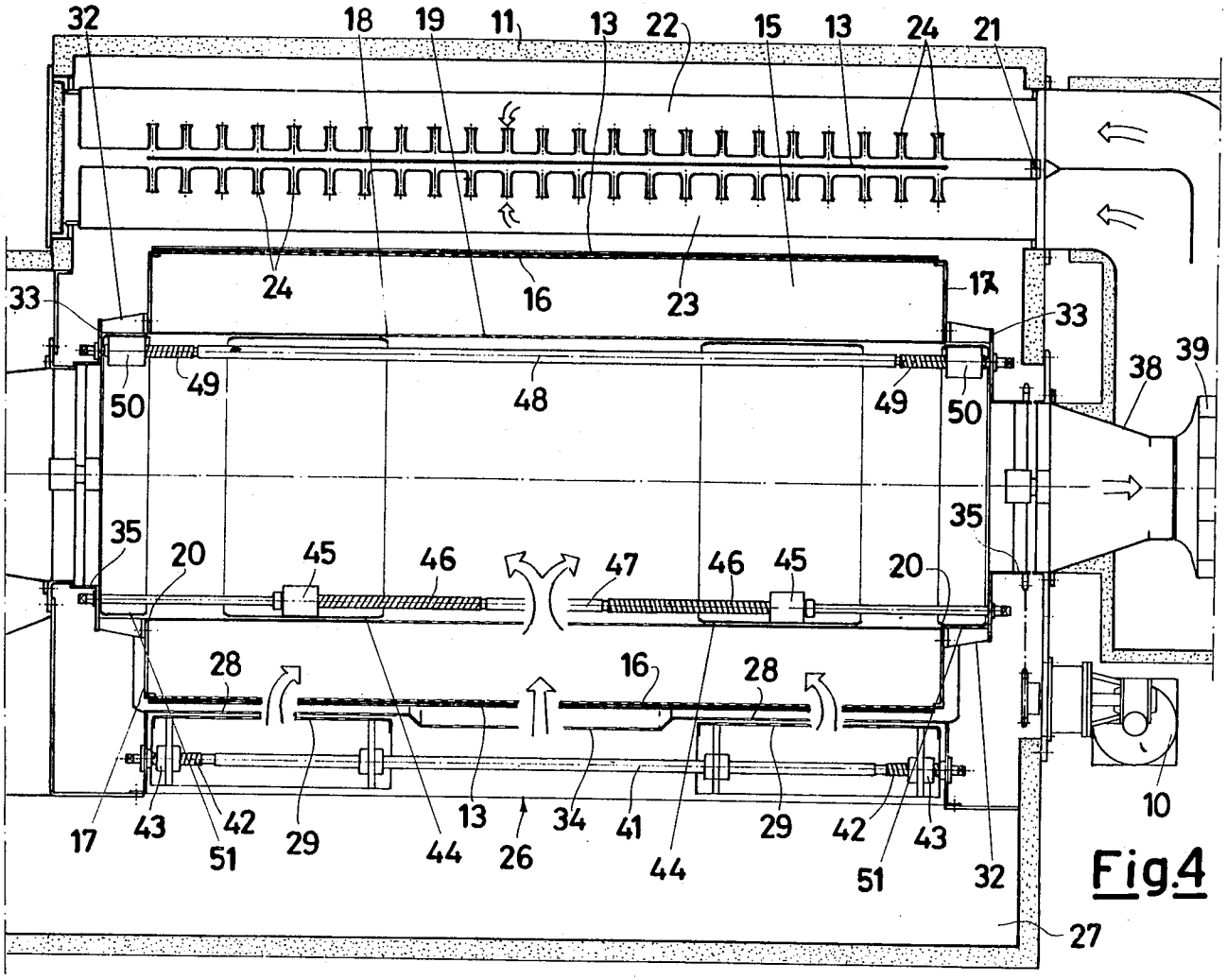
FIG. 4 is a sectional view equivalent to that of FIG. 3, in a second operating position.

In the different operating positions shown in FIG. 4, the central perforated ring-like portion 19 of the internal cylindrical element 18 of the drum 15 is open, and the annular-crown radial openings 32 of the heads of drum 15 are closed. Air blown both from channel 21 and from tanks 26 thorugh the related perforated end portions 28, and perforated central portion 34, is forced to flow through the external cylindrical element 16 of the drum 15 and the fabric 13 wound arount it, to be sucked into the interior of drum 15 by the end fans 37 and 39.

The above-disclosed operating position corresponds to the operating mode by air suction through both the drum 15 and the fabric 13 wound around it.

The suction system can be generally used to dry all weft-warp fabric types, or knitted fabric types, which are permeable to air, and do not have rolled-up selvedges.

It is evident that by means of a different positioning of the movable control devices 29, 44 and 51, it is possible to differently orientate the distribution of air blown into, and sucked from the interior of the dryer, thus a large number of combinations of the air-percussion and air-suction operating modes are obtained.

In the practical embodiment shown in the exemplifying FIGS., there is disclosed closed-loop air circulation which is, typical for example, for solvent dryers, but which can be expanded by applying the characteristics of invention to the open-loop air circulation.

What is claimed is:

1. An air percussion and air suction dryer for appratus for continuous textile treatment comprising a rotatable, perforated, cylindrical drum, means for guiding fabric for travel around said drum, a pair of opposed tanks at least partially surrounding said drum and the fabric traveling thereon, said tanks inlcuding walls facing said drum which are perforated, fan means for blowing air through the tanks to the drum to dry the fabric on the drum, means providing a suction flow passage for the air into and through said drum, and control means for controlling the air flow through said tanks and into said drum to selectively control the flow and distribution of the air to and through the fabric to be dried, said control means comprising displaceable elements including perforated sector-shaped plates facing said walls of the tank movable between open and closed positions for selectively opening and blocking air flow through said tanks to said drum.

2. An air percussion and air suction dryer for appratus for continuous textile treatment comprising a rotatable, perforated, cylindrical drum, means for guiding fabric for travel around said drum, a pair of opposed tanks at least partially surrounding said drum and the fabric traveling therein, said tanks including walls facing said drum which are perforated, fan means for blowing air through the tanks to the drum to dry the fabric on the drum, means providing a suction flow passage for the air into and through said drum, and control means for controlling the air flow through said tanks and into said drum to selectively control the flow and distribution of the air to and through the fabric to be dried, said control means comprising displaceable elements movable between open and closed positions for selectively opening and blocking air flow through said tanks to said drum, said tanks each including a central perforated region and two perforated side regions, said displaceable elements of said control means being in correspondence with said side regions for selective closure thereof while said central region remains constantly open for flow of air to said drum.

3. A dryer as claimed in claim 1 comprising a pair of spaced chests positioned on opposite side of the guided fabric in spaced relation from the drum, said chests having air outlets facing said fabric in staggered relation, said air outlets being connected to said fan means for receiving air therefrom.

4. An air percussion and air suction dryer for apparatus for continuous textile treatment comprising a rotatable, perforated, cylindrical drum, means for guiding fabric for travel around said drum, a pair of opposed tanks at least partially surrounding said drum and the fabric traveling thereon, said tanks including walls facing said drum which are perforated, fan means for blowing air ththrough the tanks to the drums to dry the fabric on the drums, means providing a suction flow passage for the fan into and through said drum, and control means for controlling the air flow through said tanks and into said drum to selectively control the flow and distribution of the air to and through the fabric to be dried, said drum comprising an outer perforated cylindrical element, and an inner cylindrical element, at least a portion of which is perforated, said inner and outer cylindrical elements being coaxial; and means supporting said drum for rotation and providing an open end in communication with the inner cylindrical element and with said fan means, said control means comprising displaceable cylindrical elements operatively movable relative to said inner cylindrical element between a closed position in which the perforated portion is closed and an open position in which the perforated portion is open.

5. A dryer as claimed in claim 4 wherein said drum has opposite ends and means are provided at said ends with openings for suction flow of air past said ends of the drum.

6. A dryer as claimed in claim 5 further comprising selectively operable means for selectively opening and closing said openings to control suction flow of the air past said ends of the drum.

7. A dryer as claimed in claim 6, wherein said openings for suction flow of air past the ends of the drum are in communication with said fan means and with said tanks via said control means.

8. A dryer as claimed in claim 4, comprising a pair of spaced chests positioned on opposite sides of the guided fabric in spaced relation from the drum, said chests having air outlets facing said fabric in staggered relation, said air outlets being connected to said fan means for receiving air therefrom.

9. An air percussion and air suction dryer for apparatus for continuous textile treatment comprising a rotatable, perforated, cylindrical drum, means for guiding fabric for travel around said drum, a pair of opposed tanks at least partially surrounding said drum and the fabric traveling thereon, said tanks including walls facing said drum which are perforated, and means for blowing air through the tanks to the drum to dry the fabric on the drum, means providing a suction flow passage for the fan into and through said drum, and control means for controlling the air flow through said tanks and into said drum to selectively control the flow and distribution of the air to and through the fabric to be dried, said control means comprising displaceable elements movable between open and closed position for selectively opening and blocking air flow through said tanks to said drum, said drum comprising an outer perforated cylindrical element, an inner cylindrical element, at least a portion of which is perforated, said inner and outer cylindrical elements being coaxial, and means supporting said drum for rotation and providing an open end in communication with the inner cylindrical element and with said fan means, said control means further comprising displaceable cylindrical elements operatively movable relative to said inner cylindrical element between a closed position in which the perforated portion is closed and an open position in which the perforated portion is open, said drum having opposite ends, means at said ends of the drum having openings for suction flow of air past said said ends of the drum, and selectively operable means for selective opening and closing said openings to control suction flow of the air past said ends of the drum, at least one of said ends of the drum being open and in communication with said fan means.

10. An air percussion and air suction dryer as claimed in claim 9 comprising a pair of spaced chests positioned on opposite sides of the guided fabric in spaced relation from the drum, said chests having air outlets facing said fabric in staggered relation, said air outlets being connected to said fan means for receiving air therefrom.

11. A dryer as claimed in claim 10 wherein said fan means comprises a fan at each end of the drum, an air feed channel connecting the fan at one of the ends of the drum to the outlets of the chests, the fan at the other end of the drum being connected to said tanks for supply of air thereto.

* * * * *